United States Patent [19]

Franko et al.

[11] Patent Number: 4,462,317

[45] Date of Patent: Jul. 31, 1984

[54] LOCK BOXES

[76] Inventors: Lloyd Franko, 9580 Crackel Rd., Aurora, Ohio 44202; Lenard Lapchynski, 8219 S. Bedford Rd., Macedonia, Ohio 44056

[21] Appl. No.: 426,286

[22] Filed: Sep. 29, 1982

[51] Int. Cl.[3] ..... B65D 55/14; A47G 29/00; E05C 19/00

[52] U.S. Cl. ..... 109/45; 232/4 R; 232/58; 70/63; 70/172; 292/304; 292/240; 220/210

[58] Field of Search ..... 109/45, 53, 49, 56, 109/57, 59 T, 60, 70, 75; 232/4 R, 62, 58; 70/63, 172, 170, 171, 168; 292/304, 240, 241; 220/210, 324, 315

[56] References Cited

U.S. PATENT DOCUMENTS

| | | | |
|---|---|---|---|
| 329,688 | 4/1885 | Taylor . | |
| 339,779 | 7/1886 | Huntley . | |
| 725,858 | 4/1903 | Mills et al. | 232/62 |
| 942,638 | 12/1909 | Grannes | 232/4 R |
| 1,093,275 | 4/1914 | Lane | 70/168 |
| 1,340,377 | 11/1920 | Cott . | |
| 1,579,520 | 7/1926 | Fleming . | |
| 1,758,361 | 2/1930 | Frost . | |
| 1,776,723 | 9/1930 | Graven | 70/168 |
| 1,869,302 | 4/1932 | Brosnan . | |
| 2,410,475 | 10/1946 | Anderson . | |
| 2,594,012 | 4/1952 | Griffin | 220/210 |
| 2,635,563 | 8/1953 | McBride . | |
| 3,083,896 | 4/1963 | Cairelli et al. . | |
| 3,527,176 | 9/1970 | Losapio | 109/57 |
| 3,741,132 | 6/1973 | Blower | 109/52 |
| 3,842,761 | 10/1974 | Bloom | 109/58 |
| 4,145,978 | 3/1979 | Johnson et al. | 109/59 R |
| 4,244,304 | 1/1981 | Read | 109/52 |
| 4,304,188 | 12/1981 | Gulbrandsen | 109/53 |
| 4,334,578 | 6/1982 | Labrum | 70/172 |
| 4,365,723 | 12/1982 | Palermo et al. | 220/210 |

FOREIGN PATENT DOCUMENTS

| | | | |
|---|---|---|---|
| 1154671 | 6/1969 | United Kingdom | 70/63 |

*Primary Examiner*—Gene Mancene
*Assistant Examiner*—John G. Weiss
*Attorney, Agent, or Firm*—David A. Burge

[57] ABSTRACT

A lock box includes a pair of box-like base and cover structures having side and end walls configured to overlap when the base structure is nestingly received in the cover structure. A key-operated lock is carried on the cover structure and is engageable with a receiving formation provided on the base structure. Interfitting formations are provided on the base and cover structures to assist the key-operated lock in releasably retaining the cover structure in place on the base structure. The base structure has a back wall which may be fastened to a mounting surface.

8 Claims, 18 Drawing Figures

LOCK BOXES

CROSS-REFERENCE TO RELATED APPLICATION

CONTAINER, design patent application Ser. No. 427,898 filed Sept. 29, 1982 by Lloyd Franko and Lenard Lapchynski.

BACKGROUND OF THE INVENTION

1. Field of the Invention

The present invention relates to lock boxes of the type which can be securely bolted to an existing surface, and which have removable, lockable covers for permitting valuable materials to be secured therein.

2. Prior Art

Lock boxes of a variety of types have been proposed for securing valuable materials by limiting access to those who have properly configured keys. Previously proposed lock boxes have characteristically suffered from numerous drawbacks. Most are not suitable for exterior use in that they are formed from materials which are subject to corrosion and/or they do not provide weather-protected enclosures for their contents. Most are formed from ferromagnetic materials which are not well suited for use as containers for magnetically encoded media. Most are of unduly complex construction and utilize a number of component parts which are expensive to fabricate and assemble. Most are entirely unsuitable for use as pickup-and-delivery repositories for audio and video tape cassettes which are delivered on a subscription basis to residential dwellings, or for use as highly secure mail boxes to receive mail which includes checks and other valuable documents.

SUMMARY OF THE INVENTION

The present invention overcomes the foregoing and other drawbacks of prior proposals by providing novel and improved lock boxes of simple and inexpensive construction which are formed from minimal numbers of easily assembled parts.

In accordance with the preferred practice of the present invention, a lock box includes base and cover structures formed from plastics material. Each of the base and cover structures is of single piece construction, formed by molding techniques. The base and cover structures are of box-like construction, having side and end walls which overlap when the base structure is nestingly received in the cover structure. A key-operated lock is carried by the cover structure and is engageable with a receiving formation provided on the base structure. Interfitting formations are provided on the base and cover structures to assist the key-operated lock in releasably retaining the cover structure in place on the base structure. The base structure has a back wall which may be fastened to a mounting surface.

BRIEF DESCRIPTION OF THE DRAWINGS

The foregoing and other features of the present invention will be better understood by referring to the description of the preferred embodiment and the claims which follow, taken together with the accompanying drawings, wherein:

DESCRIPTION OF THE PREFERRED EMBODIMENTS

Figure 1:
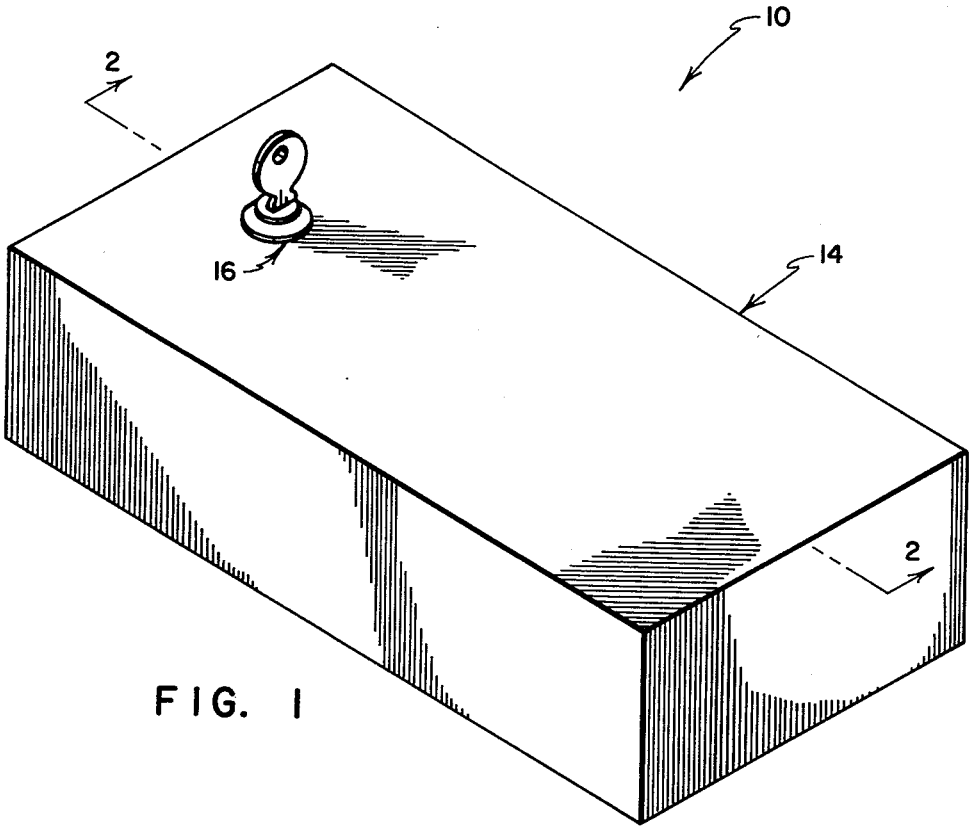
FIG. 1 is a perspective view of one embodiment of a lock box incorporating features of the present invention, with the base and cover structures of the box in a nested, locked position.

Referring to FIGS. 1–6, one embodiment of a lock box incorporating features of the present invention is indicated generally by the numeral 10. The lock box 10 includes a base structure 12 and a cover structure 14. A key-operated lock assembly 16 is carried by the cover structure 14 and is engageable with a receiving formation 18 carried by the base structure 12.

The base structure 12 is preferably formed from plastics or die-cast material using molding techniques. The base structure 12 has a back wall 20, forwardly-extending end walls 22, 24, and forwardly-extending side walls 26, 28 which cooperate to define a forwardly-opening storage cavity 30. A bar 32 extends through the storage cavity 30 and interconnects the side walls 26, 28. The receiving formation 18 tabs to form a notch 34 formed in one side of the bar 32. An end wall 35 defines the depth of the notch 34. An elongate rib 36 is formed on the end wall 24 and extends along a majority of the length of the end wall 24. One or more suitable mounting holes 38 may be provided through the back wall 20 for receiving threaded fasteners or the like (not shown) to secure the base structure 12 to an existing surface.

The cover structure 14 is preferably formed from plastics or die-cast material using molding techniques. The cover structure 14 has a front wall 40, rearwardly-extending end walls 42, 44, and rearwardly-extending side walls 46, 58 which cooperate to define a rearwardly-opening cavity 50 which will nestingly receive the base structure 12. A mounting hole 52 extends through the front wall 40. An elongate, inwardly-facing groove 56 is formed on the end wall 44.

Figure 2:
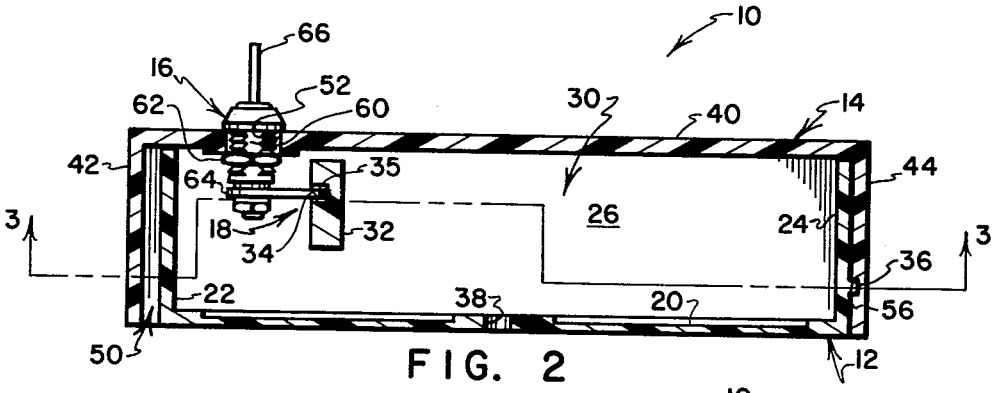
FIG. 2 is a sectional view as seen from a plane indicated by a line 2—2 in FIG. 3.
Figure 3:
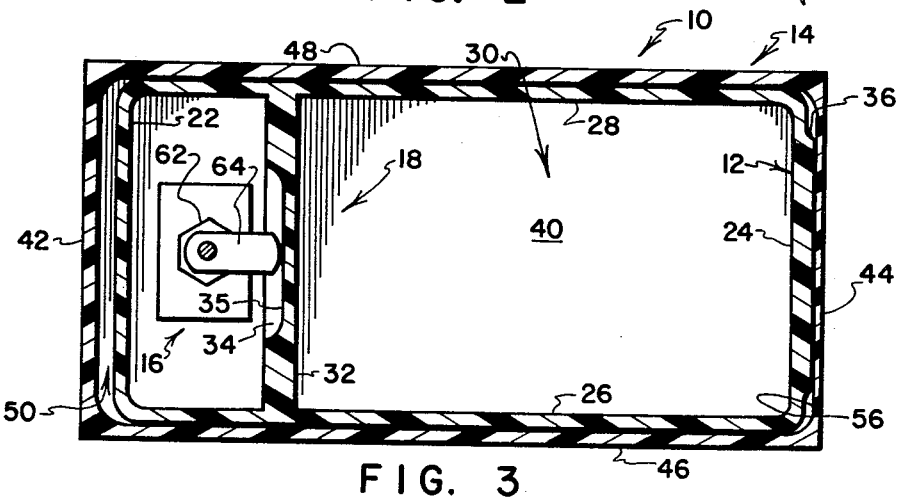
FIG. 3 is a sectional view as seen from planes indicated by a broken line 3—3 in FIG. 2.

The key-operated lock assembly 16 has a threaded cylinder 60 which extends through the mounting hole 52 and is secured in place by a nut 62. The lock assembly 16 has a rotary bolt 64 which is movable in response to turning of a key 66. The bolt 64 is movable between an unlocked position wherein it disengages the bar 32 as shown in FIGS. 4 and 5, and a locked position wherein it extends into the notch 34 formed in the bar 32, as is shown in FIGS. 2 and 3.

The base and cover structures 12, 14 carry interfitting locking formations on their end walls 24, 44. The base-carried rib 36 and the cover-carried groove 56 are engageable one within the other when the base and cover structures 12, 14 are nested, as is shown in FIGS. 2 and 3.

Figure 4:
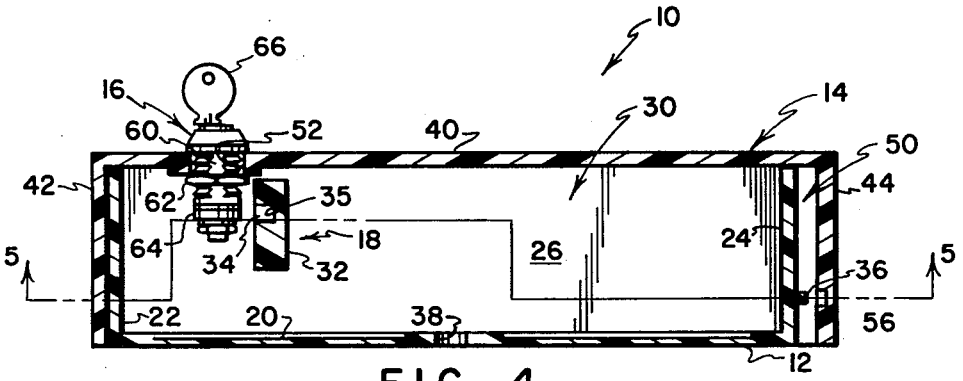
FIG. 4 is a sectional view similar to FIG. 2 with the base and cover of the box shown in a nested but unlocked, ready-to-open position.
Figure 5:
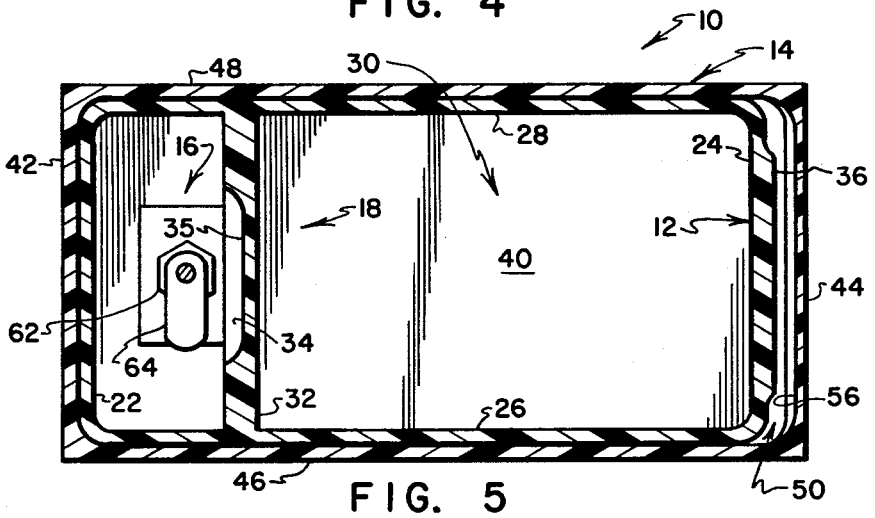
FIG. 5 is a sectional view as seen from planes indicated by a broken line 5—5 in FIG. 4.
Figure 6:
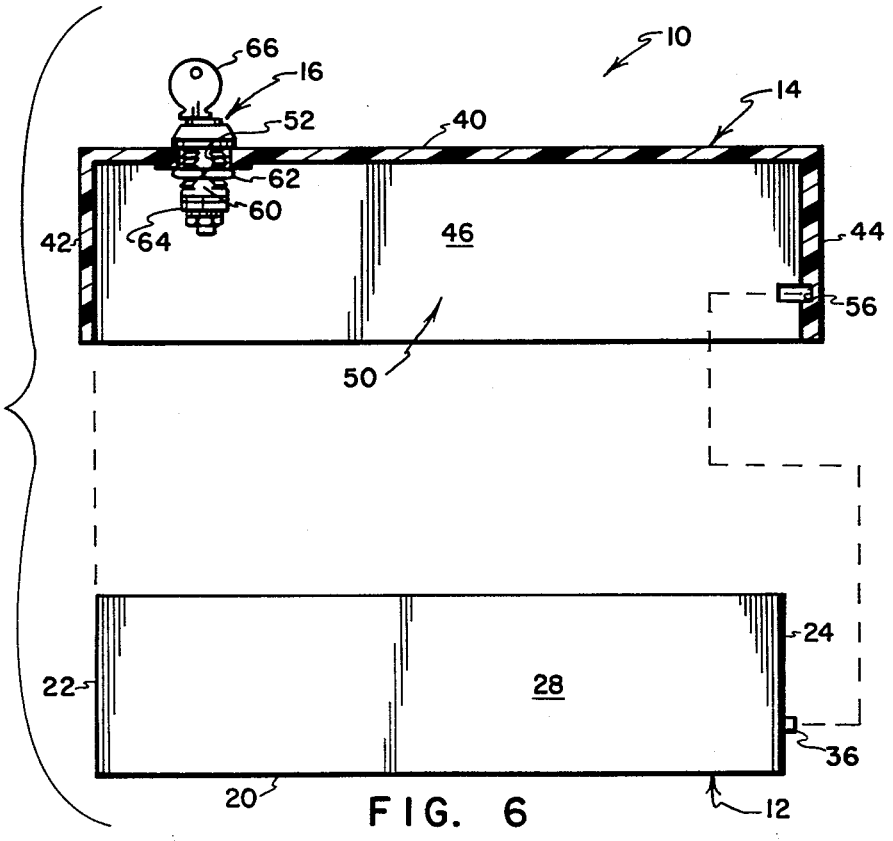
FIG. 6 is an exploded view with the cover structure shown in cross-section as in FIG. 4, but with the base shown in side elevation.
Figure 7:
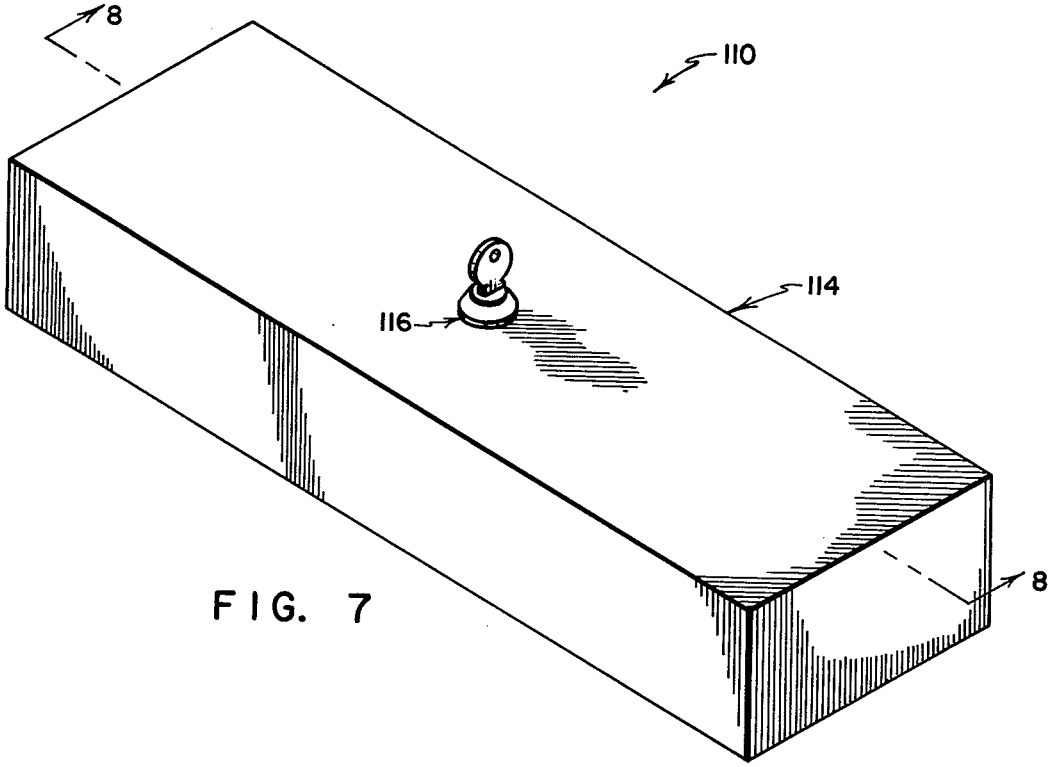
FIG. 7 is a perspective view of a second embodiment of a lock box incorporation features of the present invention, with the base and cover structures of the box in a nested, locked position.
Figure 8:
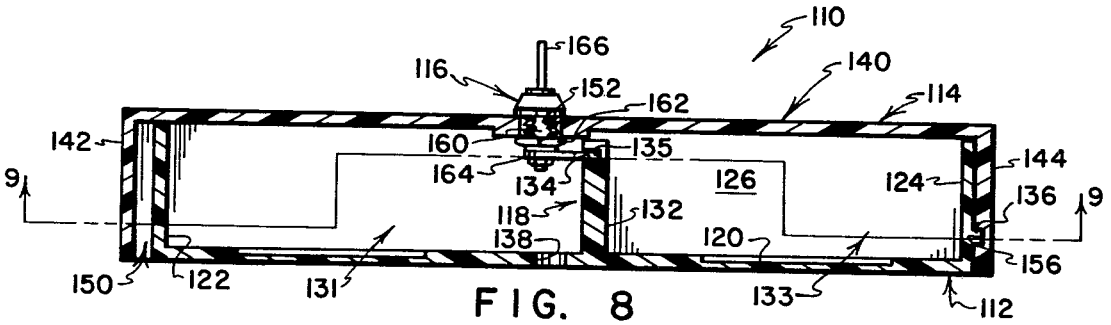
FIG. 8 is a sectional view as seen from a plane indicated by a line 8—8 in FIG. 9.
Figure 9:
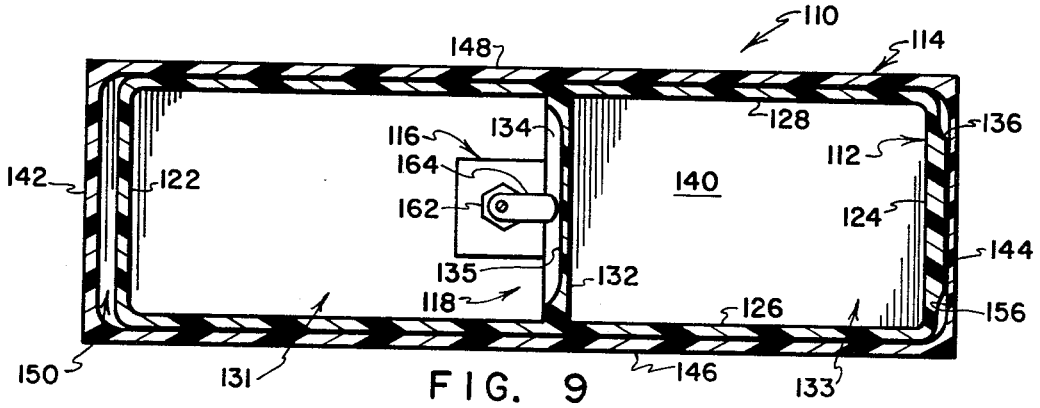
FIG. 9 is a sectional view as seen from planes indicated by a broken line 9—9 in FIG. 8.
Figure 10:
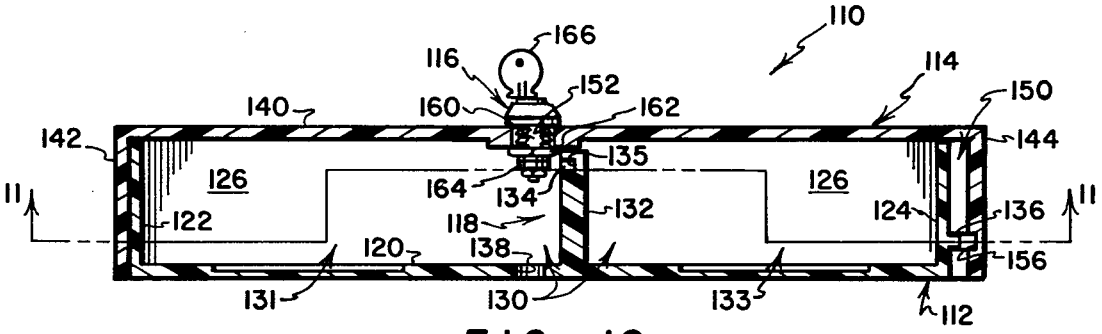
FIG. 10 is a sectional view similar to FIG. 8 with the base and cover of the box shown in a nested but unlocked, ready-to-open position.
Figure 11:
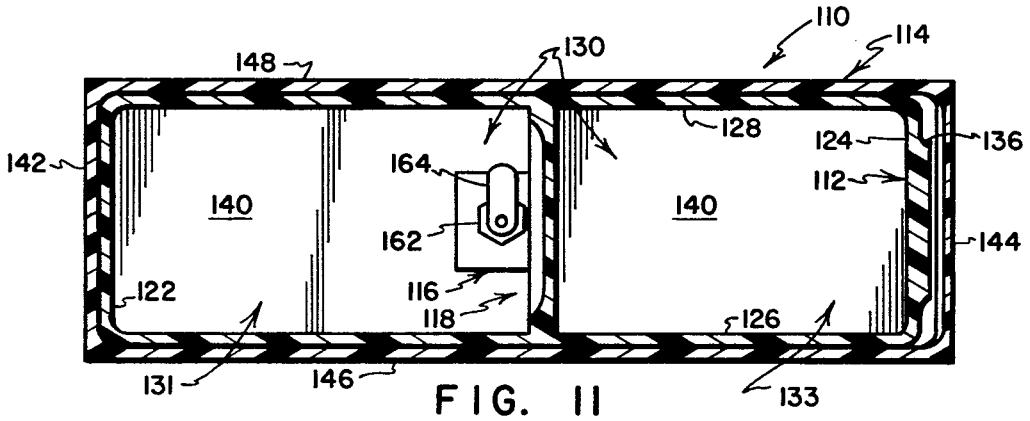
FIG. 11 is a sectional view as seen from planes[2] indicated by a broken line 11—11 in FIG. 10.
Figure 12:
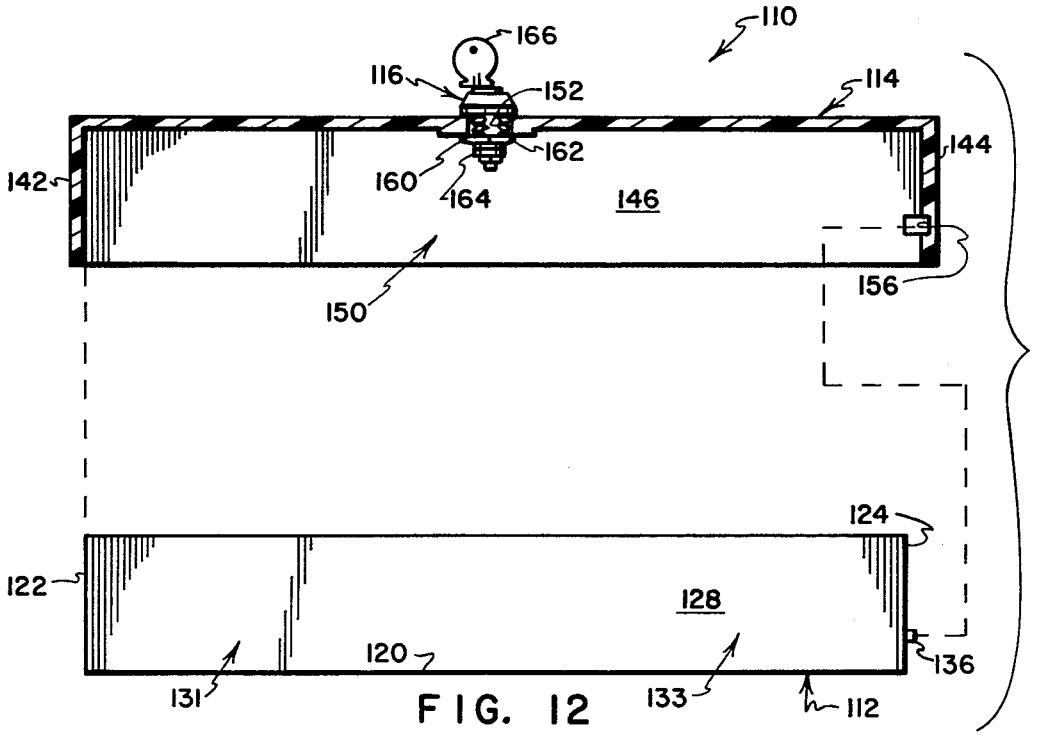
FIG. 12 is an exploded view with the cover structure shown in cross-section as in FIG. 10, but with the base structure shown in side elevation.
Figure 13:
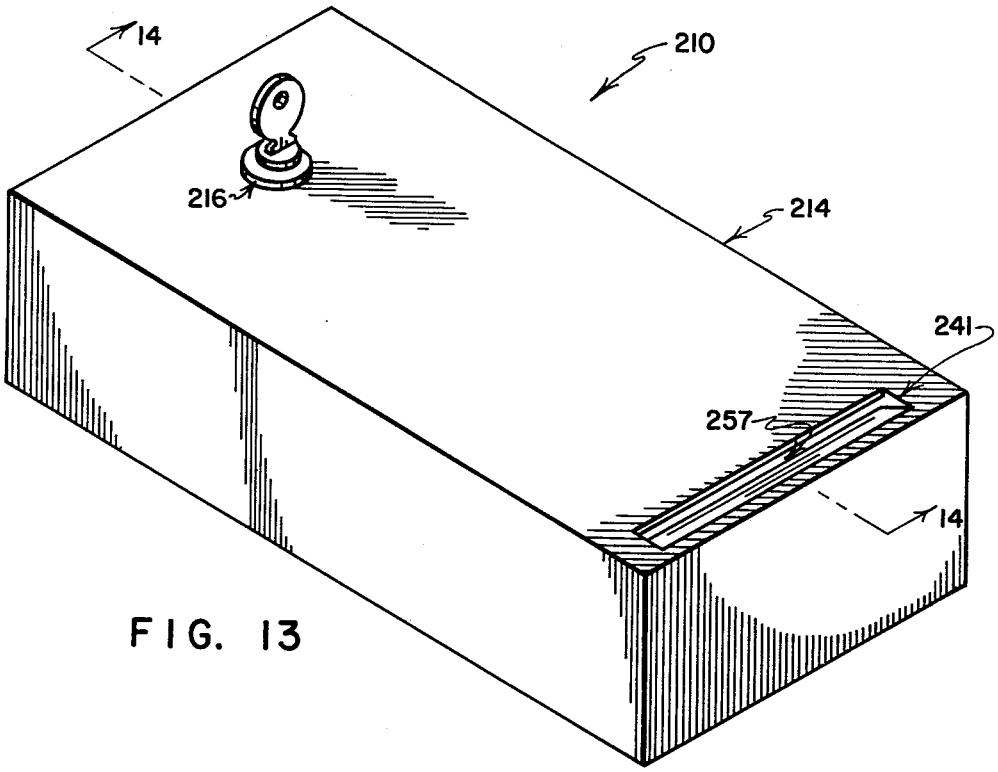
FIG. 13 is a perspective view of a third embodiment of a lock box incorporating features of the present invention, with the base and cover structures of the box in a nested, locked position.
Figure 14:
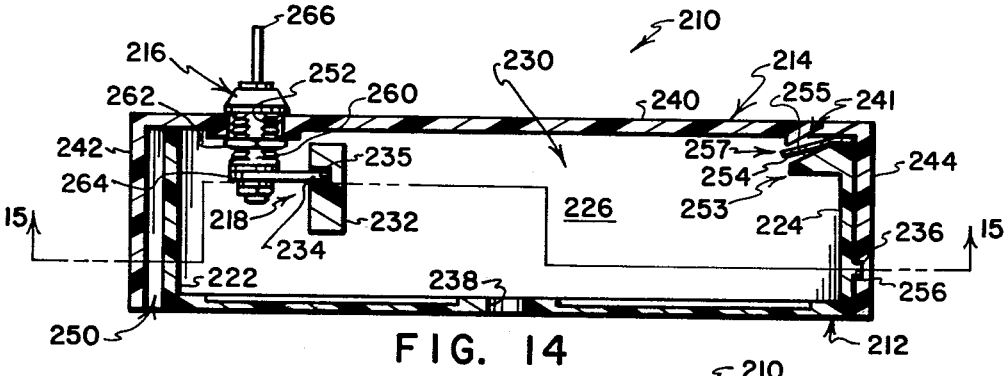
FIG. 14 is a sectional view as seen from planes indicated by a broken line 14—14 in FIG. 13.
Figure 15:
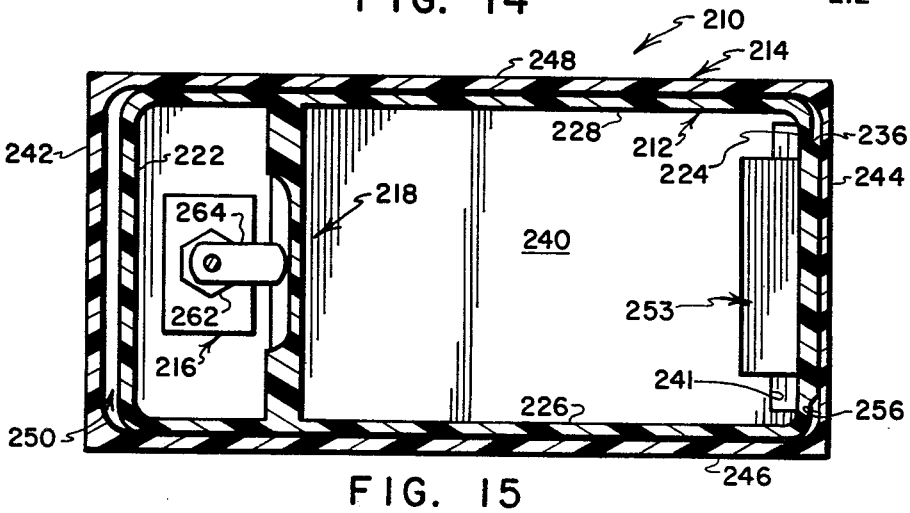
FIG. 15 is a sectional view as seen from planes indicated by a broken line 15—15 in FIG. 14.
Figure 16:
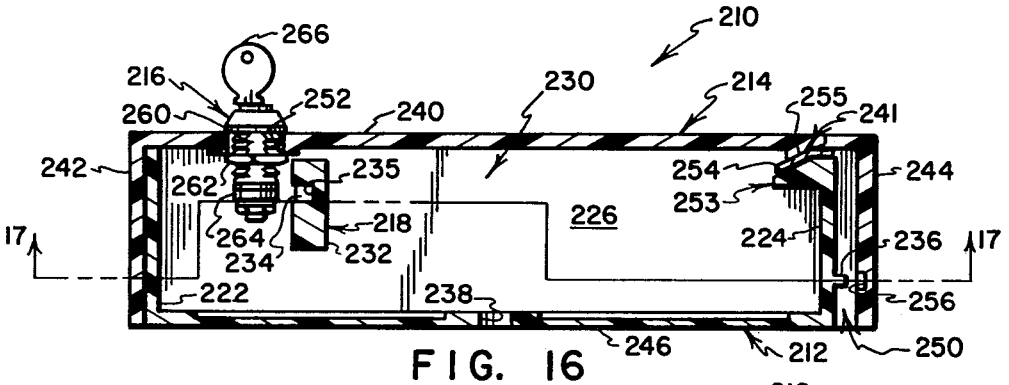
FIG. 16 is a sectional view similar to FIG. 14 with the base and cover of the box shown in a nested but unlocked, ready-to-open position.
Figure 17:
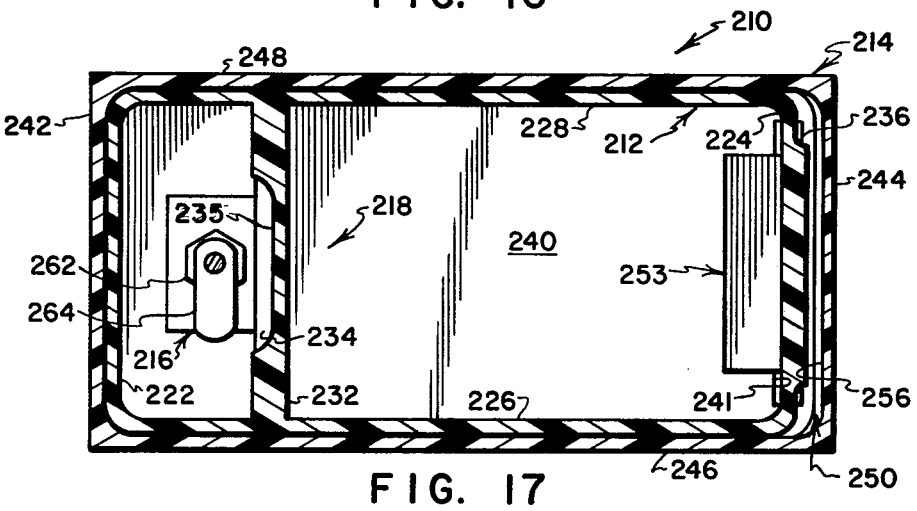
FIG. 17 is a sectional view as seen from planes indicated by a broken line 17—17 in FIG. 16; and, FIG. 18 is an exploded view with the cover structure shown in cross section as in FIG. 15, but with the base structure shown in side elevation.
Figure 18:
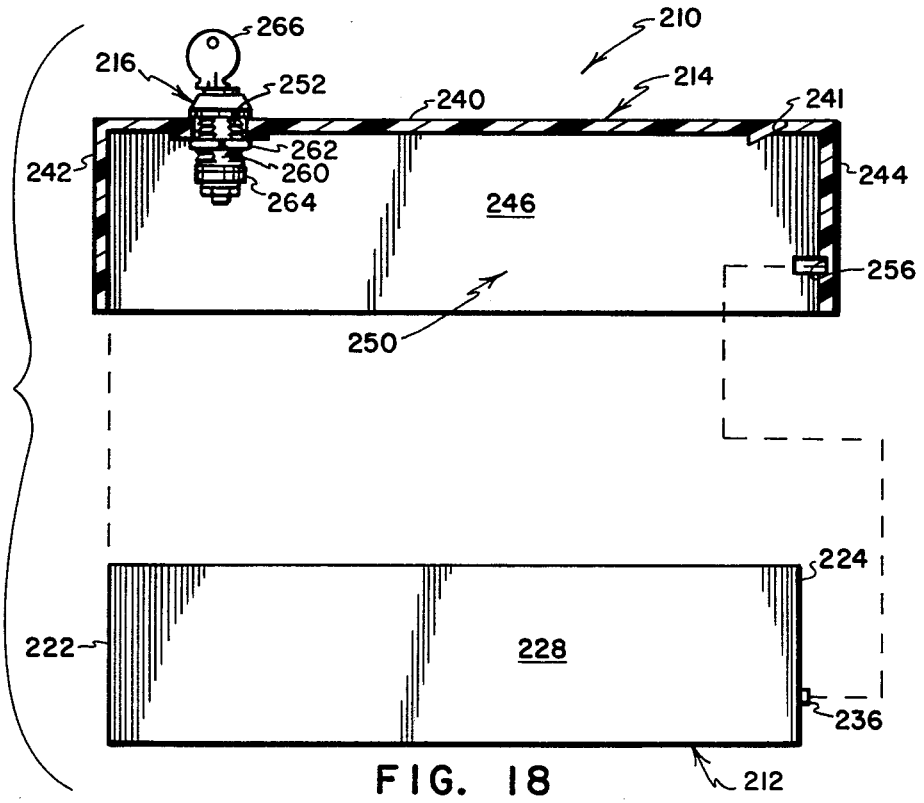

The cavity 50 defined by the cover structure 14 is sufficiently longer than the base structure 12 to permit the rib 36 to disengage the groove 56 when the base and cover structures 12, 14 are nested, as shown in FIGS. 4 and 5, whereby the cover structure 14 may be removed from the base structure 12. When the lock bolt 64 is rotated into locking engagement with the notch 34 formed in the bar 32, a camming action takes place as the bolt 64 engages the end wall 35. This camming action effects relative movement of the base and cover structures 12, 14 to bring the base-carried rib 36 into interfitting engagement with the cover-carried groove 56. This interfitting engagement, coupled with the bolt 64 being received in the notch 34, serve to retain the cover structure 14 in place on the base structure 12.

Referring to FIGS. 7–12, a second embodiment of a lock box incorporating features of the present invention is indicated generally by the numeral 110. The lock box 110 includes a base structure 112 and a cover structure 114. A key-operated lock assembly 116 is carried by the cover structure 114 and is engageable with a receiving formation 118 carried by the base structure 112.

The base structure 112 is preferably formed from plastics or die-cast material using molding techniques. The base structure 112 has a back wall 120, forwardly-extending end walls 122, 124, and forwardly-extending side walls 126, 128 which cooperate to define a forwardly-opening storage cavity 130. A bar 132 extends through the storage cavity 130 at a central location between the end walls 122, 124, and interconnects the side walls 126, 128 and the back wall 120 to define two forwardly-opening storage compartments 131, 133. The receiving formation 118 takes the form of a noth 134 formed in one side of the bar 132. An end wall 135 defines the depth of the notch 134. An elongate rib 136 is formed on the end wall 124 and extends along a majority of the length of the end wall 124. One or more suitable mounting holes 138 may be provided through the back wall 120 for receiving threaded fasteners or the like (not shown) to secure the base structure 112 to an existing surface.

The cover structure 114 is preferably formed from plastics or die-cast material using molding techniques. The cover structure 114 has a front wall 140, rearwardly-extending end walls 142, 144, and rearwardly-extending side walls 146, 148 which cooperate to define a rearwardly-opening cavity 150 which will nestingly receive the base structure 112. A mounting hole 152 extends through the front wall 140. An elongate, inwardly-facing groove 156 is formed on the end wall 144.

The key-operated lock assembly 116 has a threaded cylinder 160 which extends through the mounting hole 152 and is secured in place by a nut 162. The lock assembly 116 has a rotary bolt 164 which is movable in response to turning of a key 166. The bolt 164 is movable between an unlocked position wherein it disengages the bar 132 as shown in FIGS. 4 and 5, and a locked position wherein it extends into the notch 134 formed in the bar 132, as is shown in FIGS. 2 and 3.

The base and cover structures 112, 114 carry interfitting locking formations on their end walls 124, 144. The base-carried rib 136 and the cover-carried groove 156 which are engageable one within the other when the base and cover structures 112, 114 are nested, as is shown in FIGS. 2 and 3.

The cavity 150 defined by the cover structure 114 is sufficiently longer than the base structure 112 to permit the rib 136 to disengage the groove 156 when the base and cover structures 112, 114 are nested, as shown in FIGS. 4 and 5, whereby the cover structure 114 may be removed from the base structure 112. When the lock bolt 164 is rotated into locking engagement with the notch 134 formed in the bar 132, a camming action takes place as the bolt 164 engages the end wall 135. This camming action effects relative movement of the base and cover structures 112, 114 to bring the base-carried rib 136 into interfitting engagement with the cover-carried groove 156. This interfitting engagement coupled with the bolt 164 being received in the notch 134, serve to retain the cover structure 114 in place on the base structure 112.

Referring to FIGS. 13–18, a third embodiment of a lock box incorporating features of the present invention is indicated generally by the numeral 210. The lock box 210 includes a base structure 212 and a cover structure 214. A key-operated lock assembly 216 is carried by the cover structure 214 and is engageable with a receiving formation 218 carried by the base structure 212.

The base structure 212 is preferably formed from plastics or die-cast material using molding techniques. The base structure 212 has a back wall 220, forwardly-extending end walls 222, 224, and forwardly-extending side walls 226, 228 which cooperate to define a forwardly-opening storage cavity 230. A bar 232 extends through the storage cavity 230 and interconnects the side walls 226, 228. The receiving formation 218 takes the form of a notch 234 formed in one side of the bar 132. An end wall 235 defines the depth of the notch 234. An elongate rib 236 is formed on the end wall 224 and extends along a majority of the length of the end wall 224. An inwardly extending projection 253 is formed along a portion of the top edge of the end wall 224. The projection 253 has an incline surface 254 to which a resilient member 255 is connected. One or more suitable mounting holes 238 may be provided through the back wall 220 for receiving threaded fasteners or the like (not shown) to secure the base structure 212 to an existing surface.

The cover structure 214 is preferably formed from plastics or die-cast material using molding techniques. The cover structure 214 has a front wall 240, rearwardly-extending end walls 242, 244, and rearwardly-extending side walls 246, 248 which cooperate to define a rearwardly-opening cavity 250 which will nestingly receive the base structure 212. The front wall 240 defines a slot 241 extending along a portion of wall 240 near the end wall 244. A mounting hole 252 extends through the front wall 240. An elongate, inwardly-facing groove 256 is formed on the end wall 244.

The key-operated lock assembly 216 has a threaded cylinder 260 which extends through the mounting hole 252 and is secured in place by a nut 262. The lock assembly 216 has a rotary bolt 264 which is movable in response to turning of a key 266. The bolt 264 is movable between an unlocked position wherein it disengages the bar 232 as shown in FIGS. 4 and 5, and a locked position wherein it extends into the notch 234 formed in the bar 232, as is shown in FIGS. 2 and 3.

The base and cover structures 212, 214 carry interfitting locking formations on their end walls 224, 244. The base-carried rib 236 and the cover-carried groove 256 which are engageable one within the other when the base and cover structures 212, 214 are nested, as is shown in FIGS. 2 and 3.

The cavity 250 defined by the cover structure 214 is sufficiently longer than the base structure 212 to permit the rib 236 to disengage the groove 256 when the base and cover structures 212, 214 are nested, as shown in FIGS. 4 and 5, whereby the cover structure 214 may be removed from the base structure 212. When the lock bolt 264 is rotated into locking engagement with the notch 234 formed in the bar 232, a camming action takes place as the bolt 264 engages the end wall 235. This camming action effects relative movement of the base and cover structures 212, 214 to bring the base-carried rib 236 into interfitting engagement with the cover-carried groove 256. This interfitting engagement, coupled with the bolt 264 being received in the notch 234, serve to retain the cover structure 214 in place on the base structure 212.

When the base structure 212 and cover structure 214 are locked together, the cover-carried slot 241 and base-carried projection 253 cooperate to form a passage 257. The passage 257 provides access to the storage cavity 230 when the base 212 and cover 214 are in locking relation. The resilient member 255 is self biased toward a position wherein it tends to close off the passage 257 to provide a weatherproof passage closure which assists in protecting contents of the box 210. When an article such as a letter carried in an envelope is admitted through the passage 257, the member 255 is moved by the article toward the inclined surface 254 to allow the article to enter the box 210 through the passage 257.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A lock box, comprising:

(a) a generally rectangular, box-like base structure having:
  (i) a generally rectangular back wall;
  (ii) a first pair of side walls which project forwardly from opposed sides of the back wall, and a first pair of end walls which project forwardly from opposed ends of the back wall, the first side walls and the first end walls cooperating to define a forwardly-opening cavity;
  (iii) a bar extending through the cavity interconnecting the first side walls;
  (iv) a receiving formation provided in the bar;

(b) a generally rectangular, box-like cover structure having:
  (i) a generally rectangular front wall;
  (ii) a second pair of side walls which project rearwardly from opposed sides of the front wall, and a second pair of end walls which project rearwardly from opposed ends of the front wall, the second side walls and the second end walls cooperating to define a rearwardly-opening cavity;

(c) lock assembly means carried by the cover structure and having a bolt which is movable selectively into and out of engagement with the receiving formation when the cover structure is in a closed position with respect to the base structure;

(d) the cover structure being configured to nestingly receive the base structure within its rearwardly-opening cavity with the first and second side walls overlying each other and with the first and second end walls overlying each other, and with the front wall closing the forwardly-opening cavity defined by the base structure;

(e) the side walls of the base structure and the cover structure being configured to closely overlie each other when the base structure is received within the rearwardly-opening cavity of the cover structure to substantially eliminate relative side-to-side movement of the base structure and cover structure when these structures are nested, in contrast to the end walls of the base structure and the cover structure which are arranged to permit a limited range of relative movement between the base structure and the cover structure when these structures are nested;

(f) interfitting formation means carried on at least one of the end walls of the base structure and at least one of the end walls of the cover structure, the interfitting formation means being movable into and out of interfitting engagement as the base and cover structures are moved relative to each other while nested; and, (g) the lock assembly means being operable, when actuated while the base and cover structures are nested, to engage the receiving formation to releasably maintain the base and cover structures in their nested relationship, and to effect relative movement of the base and cover structures to a position wherein the interfitting formation means engage to assist the lock assembly in retaining the base and cover structures in their nested relationship.

2. The lock box of claim 1 wherein the receiving formation includes a groove formed in the bar, and the lock bolt is configured such that it is caused to project into the groove when the lock assembly is actuated while the base and cover structures are nested.

3. The lock box of claim 2 wherein the groove has an end wall at the base of the groove, and the lock bolt is engageable with the groove's end wall when the lock is actuated to effect a camming action which causes relative movement of the base and cover structures to effect engagement of the interfitting formation means.

4. The lock box of claim 1 wherein the interfitting formation means include a projection carried on said at least one end wall of one of the base and cover structures, and a projection-receiving groove carried on said at least one end wall of the other of the base and cover structures.

5. The lock box of claim 1, wherein the bar extends through the forwardly-facing cavity at a substantially central location between the end walls of the base structure, and divides the forwardly-facing cavity into a pair of compartments.

6. The lock box of claim 1 wherein at least one of the base and cover structures carries an elongate slot for admitting objects to the lock box when the base and cover structures are nested.

7. The lock box of claim 6 wherein each of the base and cover structures is provided with path-defining means in close proximity to the slot for defining an elongate, relatively narrow travel path extending from the elongate slot, along which objects being admitted into the lock box when the base and cover structures are nested must pass.

8. The lock box of claim 7 wherein at least one of the path-defining means includes a relatively resilient member which projects at least part way into the travel path, and which is movable out of the travel path by an article being admitted to the lock box along the travel path.

* * * * *